US012050077B1

(12) United States Patent
Carlson et al.

(10) Patent No.: US 12,050,077 B1
(45) Date of Patent: Jul. 30, 2024

(54) LINKLESS AMMUNITION HANDLING SYSTEM

(71) Applicant: Nobles Worldwide, Inc., St. Croix Falls, WI (US)

(72) Inventors: David S. Carlson, Chisago City, MN (US); Vincent R. Virga, Lindstrom, MN (US); Joseph G. Virga, Lindstrom, MN (US); Jacob S. Dubose, Forest Lake, MN (US); Thomas H. Thoe, St. Croix Falls, WI (US); Joshua J. Smith, Turtle Lake, WI (US)

(73) Assignee: Nobles Worldwide, Inc., St. Croix Falls, WI (US)

( * ) Notice: Subject to any disclaimer, the term of this patent is extended or adjusted under 35 U.S.C. 154(b) by 0 days.

(21) Appl. No.: 17/971,278

(22) Filed: Oct. 21, 2022

(51) Int. Cl.
*F41A 9/57* (2006.01)

(52) U.S. Cl.
CPC ..... *F41A 9/57* (2013.01)

(58) Field of Classification Search
CPC ..... F41A 9/01; F41A 9/09; F41A 9/10; F41A 9/11; F41A 9/13; F41A 9/14; F41A 9/16; F41A 9/54; F41A 9/55; F41A 9/56; F41A 9/57
USPC ..... 89/33.01
See application file for complete search history.

(56) References Cited

U.S. PATENT DOCUMENTS 3,429,221 A 2/1969 Kirkpatrick
3,563,357 A 2/1971 West
3,670,863 A * 6/1972 Meier ..... F41A 9/04 89/33.03
4,492,144 A 1/1985 Dix
4,781,100 A 11/1988 Baldwin
4,982,650 A 1/1991 Bender-Zanoni et al.
5,076,138 A 12/1991 Mannhart et al.
(Continued)

FOREIGN PATENT DOCUMENTS

EP 0152549 A1 11/1984
EP 0095195 B1 4/1987
(Continued)

OTHER PUBLICATIONS

General Dynamics Ordnance and Tactical Systems; F-16 20MM Gatling Gun System; St. Petersburg, Florida, USA.

*Primary Examiner* — Bret Hayes
(74) *Attorney, Agent, or Firm* — Angela Holt; Frank M. Caprio; Bradley Arant Boult Cummings LLP

(57) ABSTRACT

A linkless ammunition handling system for a medium caliber weapon has a first magazine configured to store a plurality of individual ammunition rounds. The first magazine conveys ammunition rounds to a first magazine interface unit. The first magazine interface unit conveys ammunition rounds to a first flexible feed chute subassembly. The first flexible feed chute subassembly conveys ammunition rounds to a first gun interface unit. The first gun interface unit conveys ammunition rounds to a gun feeder. A second magazine is also configured to store a plurality of individual ammunition rounds. The second magazine conveys ammunition rounds to a second magazine interface unit. The second magazine interface unit conveys ammunition rounds to a second flexible feed chute subassembly. The second flexible feed chute subassembly conveys ammunition rounds to a second gun interface unit. The second gun interface unit conveys ammunition rounds to the gun feeder.

13 Claims, 12 Drawing Sheets

(56) References Cited

U.S. PATENT DOCUMENTS

| | | | | | |
|---|---|---|---|---|---|
| 5,097,742 | A * | 3/1992 | Gaye | F41A 9/76 | |
| | | | | 89/34 | |
| 5,149,909 | A | 9/1992 | Hagen et al. | | |
| 5,175,388 | A * | 12/1992 | Maher | F41A 9/04 | |
| | | | | 89/35.01 | |
| 5,392,685 | A | 2/1995 | Stoner | | |
| 2008/0121099 | A1 * | 5/2008 | Cummings | F41A 9/49 | |
| | | | | 89/33.01 | |
| 2009/0120271 | A1 | 5/2009 | Diller et al. | | |

FOREIGN PATENT DOCUMENTS

| | | | | |
|---|---|---|---|---|
| EP | 0338301 | A1 | 4/1989 | |
| WO | 2005031243 | A1 | 4/2005 | |
| WO | WO-2017080800 | A1 * | 5/2017 | F41A 9/30 |

* cited by examiner

LINKLESS AMMUNITION HANDLING SYSTEM

BACKGROUND AND SUMMARY

Ammunition handling systems for medium caliber weapons systems (e.g., those supporting 30 mm and 50 mm ammunition) have traditionally utilized direct mount technology or a closed loop system. A direct mount system is typically used where turret layout can accommodate ammunition storage near the weapon. A direct mount system requires high-density ammunition storage close to the gun for convenient uploading and downloading, so its capacity is limited by turret height and width.

In contrast, a closed loop system decouples bulk storage from the gun, which makes it adaptable for unique turret shapes and challenging space availabilities. The closed loop system allows loading and unloading of ammunition at different places along the ammunition feed path. Ammunition is also stored in the feed path itself. An advantage of a closed loop system is that it allows a turret designer to place the ammunition storage and loading zones at various places within the turret.

A "hybrid" system as disclosed herein combines closed loop linkless with direct mount technology, to obtain the benefits of both types of systems. Bulk storage is decoupled from the weapon, and there is additional ammunition storage in the feed path.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
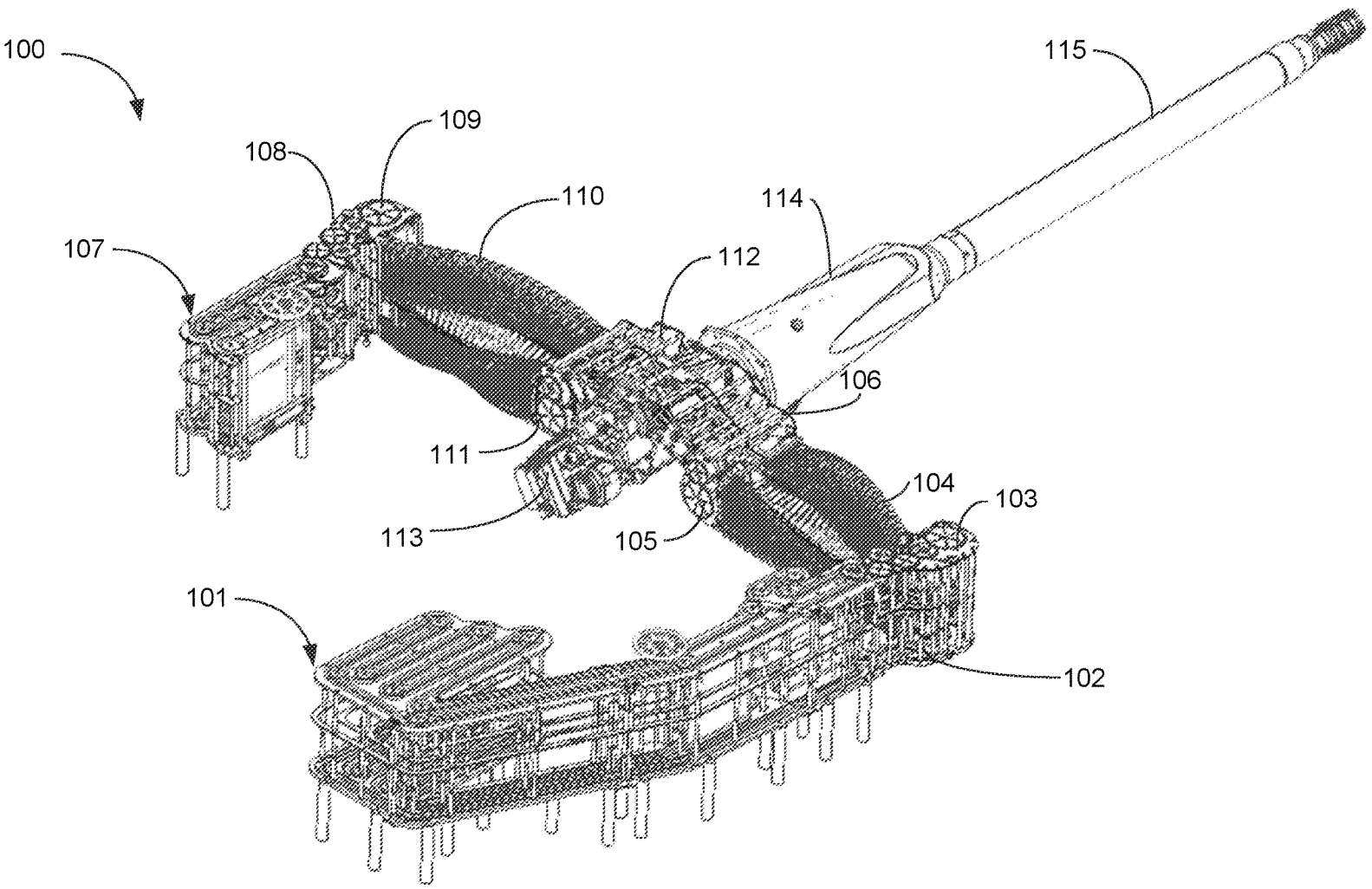
FIG. 1 depicts an ammunition handling system according to an exemplary embodiment of the present disclosure.

FIG. 1 depicts a linkless ammunition handling system 100 according to an exemplary embodiment of the present disclosure. The system 100 comprises a first magazine 101 that feeds ammunition into a first magazine interface unit 102. The first magazine interface unit 102 transmits the ammunition into a first magazine turnaround unit 103. The first magazine turnaround unit 103 transmits ammunition into a first flexible feed chute 104. In this regard, the first magazine turnaround unit 103 conveys ammunition rounds (not shown) onto an element belt (not shown) that transports the rounds through the first flexible feed chute 104, as further discussed herein.

The first flexible feed chute 104 transmits ammunition to a first gun turnaround unit 105. The first gun turnaround unit 105 transmits ammunition to a first gun interface unit 106. The first gun interface unit 106 transmits ammunition to a gun feeder 113.

The system 100 further comprises a second magazine 107. In the illustrated embodiment, the second magazine 107 is disposed on an opposite side of the gun receiver 112 from the first magazine 101. The second magazine 107 may be substantially similar to the first magazine 101 in some embodiments. However, the capacity and layout of the second magazine 107 may be very different from the first magazine 101 in other embodiments, as an advantage of the system 100 is the configurability of the magazines 101 and 107 to the particular gun architecture at issue. Thus in the illustrated embodiment, the second magazine 107 has a smaller capacity and configuration than the first magazine 101.

The second magazine 107 feeds ammunition into a second magazine interface unit 108. The second magazine interface unit 108 is substantially similar to, and a mirror image of, the first magazine interface unit 102 in the illustrated embodiment. The second magazine interface unit 108 transmits the ammunition into a second magazine turnaround unit 109. The second magazine turnaround unit 109 transmits ammunition into a second flexible feed chute 110. In this regard, the second magazine turnaround unit 109 conveys ammunition rounds (not shown) onto an element belt (not shown) that transports the rounds through the second flexible feed chute 110, as further discussed herein. The second magazine turnaround unit 109 is substantially similar to, and a mirror image of, the first magazine turnaround unit 103 in the illustrated embodiment.

The second flexible feed chute 110 transmits ammunition to a second gun turnaround unit 111. The second gun turnaround unit 111 transmits ammunition to a second gun interface unit 112. The second gun interface unit 112 transmits ammunition to the gun feeder 113. The second flexible feed chute 110, second gun turnaround unit 111, and second gun interface unit 112 are substantially similar to and/or mirror images of the first flexible feed chute 104, first gun turnaround unit 105, and first gun interface unit 106.

Figure 2:
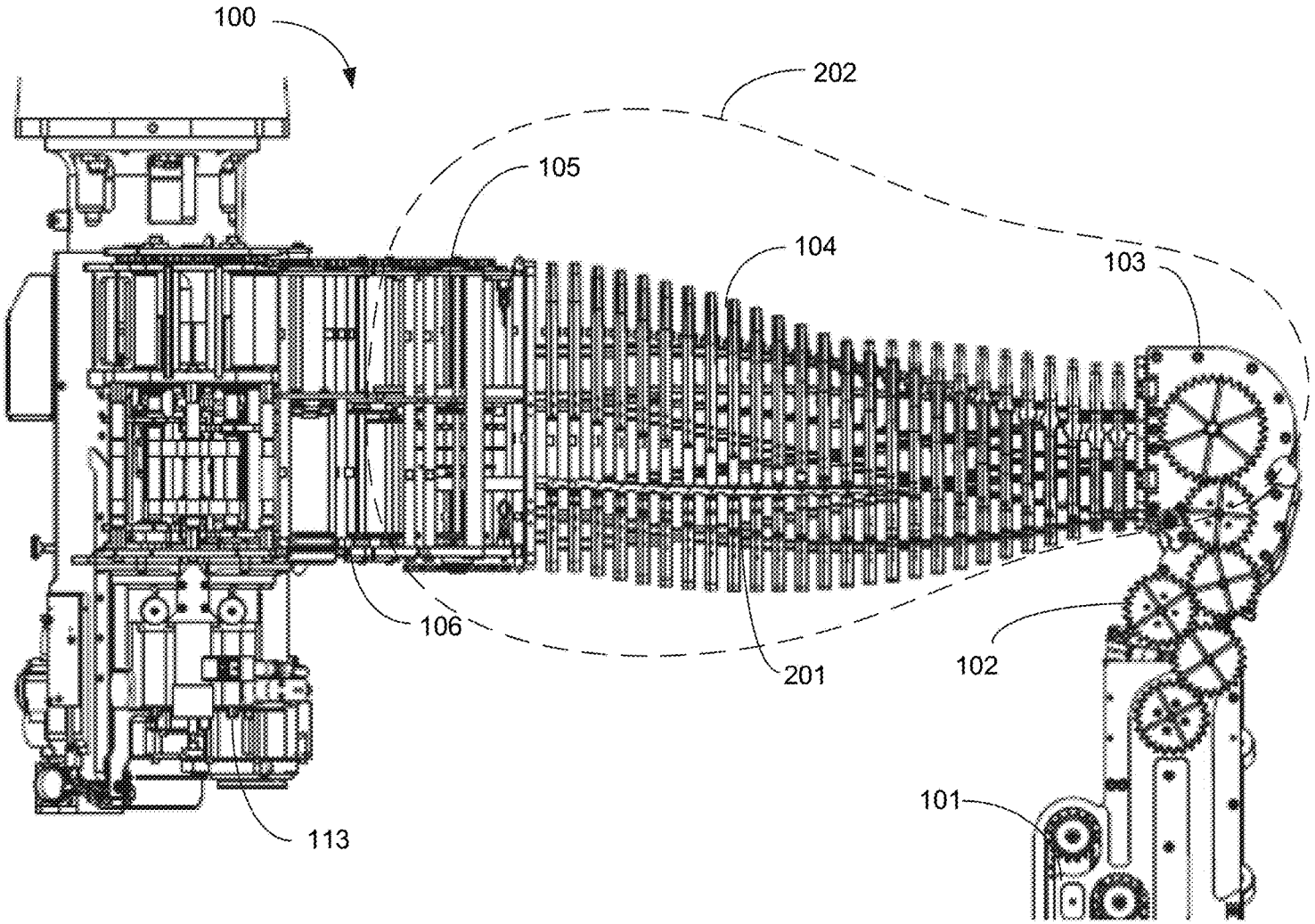
FIG. 2 is an enlarged partial view of the system of FIG. 1, showing a partial view of the first magazine.

FIG. 2 is an enlarged partial view of the system 100 of FIG. 1, showing a partial view of the first magazine 101, from which ammunition rounds (not shown) are conveyed to the first magazine interface unit 102. The first magazine interface unit 102 conveys ammunition rounds to the first magazine turnaround unit 103. The first magazine turnaround unit 103 conveys ammunition rounds through the first flexible feed chute 104 to the first gun turnaround unit 105. The first gun turnaround unit 105 conveys ammunition rounds to the first gun interface unit 106, which is connected to the gun feeder 113. The gun feeder 113 feeds ammunition rounds into the weapon.

The first flexible feed chute 104, which is substantially identical to the second flexible chute 110 (FIG. 1), is configured for complex routing of ammunition throughout the feed path, allowing for changes in weapon elevation and depression. An element belt 201 inside the first flexible feed chute 104 travels in a closed loop within the first flexible feed chute 104 in a manner similar to that of a bicycle chain. The element belt 201, which is discussed further herein with respect to FIGS. 4 and 5, conveys the ammunition rounds (not shown) along a feed path from the first magazine turnaround unit 103 to the first gun turnaround unit 105. The element belt 201 extends between the first gun turnaround unit 105 and the first magazine turnaround unit 103. Gears (not shown) on the first gun turnaround unit 105 and the first magazine turnaround unit 103 "power" the element belt 201, i.e., cause the element belt to move to transmit the ammunition rounds (not shown) through the first flexible feed chute 104.

The first magazine turnaround unit 103, first flexible feed chute 104, and first gun turnaround unit 105 are configured such that they (and the element belt extending between them) can be removed in one piece from the system. In this regard, the first magazine turnaround unit 103 is detachable from the first magazine interface unit 102 and the first gun turnaround unit 105 is detachable from the first gun interface unit 106. This configuration allows the removal of these components and the element belt without having to break the element belt. The first magazine turnaround unit 103, first flexible feed chute 104, first gun turnaround unit 105, and the element belt thus together form a flexible feed chute subassembly 202 capable of being removed from the system and replaced.

Figure 3:
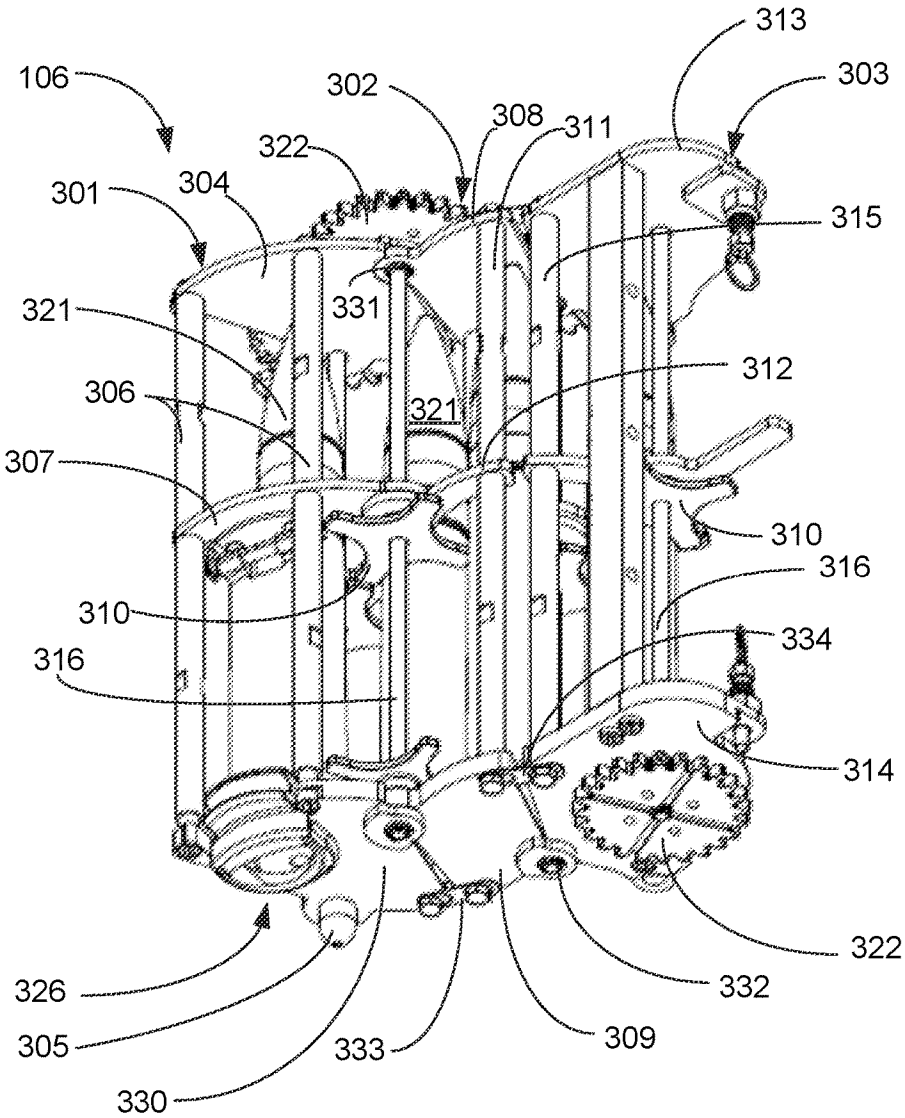
FIG. 3 is an enlarged view of a first gun interface unit according to an exemplary embodiment of the present disclosure.

FIG. 3 is an enlarged view of a first gun interface unit (GIU) 106 according to an exemplary embodiment of the present disclosure. The GIU 106 transmits ammunition between the first gun turnaround unit (GTU) 105 (FIG. 1) and the gun feeder 113 (FIG. 1). In this regard, ammunition rounds 321 are received from the first GTU 105 via sprockets 310 in the GIU 106. The sprockets 310 cradle the rounds and move them within the GIU to pass them from the GTU 104 to the gun feeder 113, as further discussed herein.

The GIU 106 is generally formed in three sections: a first section 301, a second section 302, and a third section 303. The sections 301-303 are adjustably secured together as illustrated. The first section 301 comprises a top plate 304 secured via a plurality of vertical rods 306 to a bottom plate 305. A center support 307 support is disposed mid-way between the top plate 304 and the bottom plate 305, and the rods 306 pass through the center support 307. The center support is a curved flat plate in the illustrated embodiment, slightly wider than the rods 306.

The second section 302 also comprises a top plate 308 secured to a bottom plate 309 via a plurality of vertical rods 311 (only one of which rods 311 is illustrated). A center support 312 is disposed mid-way between the top plate 308 and the bottom plate 309, and the rods 311 pass through the center support 312.

The third section 303 also comprises a top plate 313 secured to a bottom plate 314 via a plurality of rods 315 (only one of which rods 315 is illustrated). A center support (not shown) is disposed mid-way between the top plate 313 and the bottom plate 314, and the rods 315 pass through the center support.

The first section 301 and the second section 302 are adjustably secured together at a first lower pivot point 330 and a first upper pivot point 331, the first lower pivot point 330 and a first upper pivot point 331 disposed on a front side of the GIU 106. The first lower pivot point 330 and a first upper pivot point 331 enable the first section 301 to adjust relative to the second section 302. The second section 302 and the third section 303 are adjustably secured together at a second lower pivot point 332 and a second upper pivot point (not shown), the second lower pivot point 332 and second upper pivot point enabling the second section 302 to adjust relative to the third section 303. The second lower pivot point 332 and second upper pivot point are disposed on a rear side of the GIU 106. The pivot points 330-332 allow the GIU to adjust to accommodate the tolerance between the gun turnaround unit 105 (FIG. 1) and gun feeder 113 (FIG. 1), providing up to ten millimeters of adjustment.

A capture bracket 333 disposed on the rear side of the GIU 106 opposite from the first lower pivot point 331 constrains the rotation of the first section 301 with respect to the second section 302. Similarly, a capture bracket 334 disposed on the front side of the GIU opposite from the second lower pivot point 332 constrains the rotation of the second section 302 with respect to the third section 303. Similar capture brackets (not shown) are provided on the top portion of the GIU 106 as well. The capture brackets are sized to permit some adjustment between the first, second, and third sections 301-303 within a predetermined tolerance.

The sprockets 310 rotate on rods 316 that extend between the upper plates 304, 308, and 313 and the lower plates 305, 309, and 314, respectively, of the first GIU 106. In one embodiment there are three sprockets 310 on an upper portion of the GIU 106 and three sprockets on a lower portion of the GIU 106. The sprockets 310 are rotated via a plurality of gears 322. The gears 322 are powered by the gun feeder (FIG. 1).

In some embodiments of the GIU 106, a secondary load port 326 is disposed on the bottom plate 305 of the first section 301. The secondary load port 326 is configured to allow users to load individual rounds 321 directly in the feed path, without waiting for the belt to cycle through.

Figure 4:
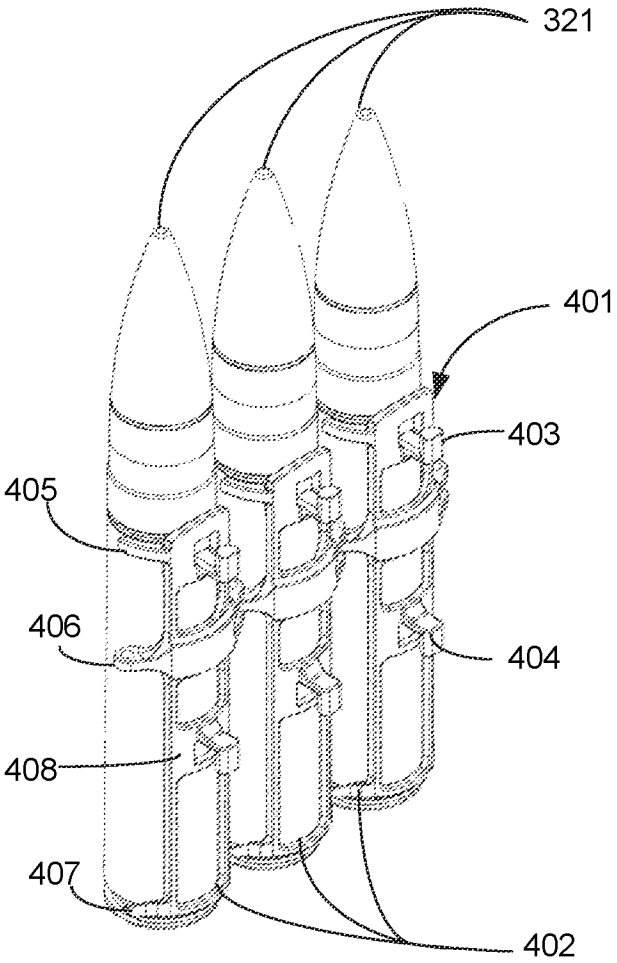
FIG. 4 depicts a partial element belt comprising three (3) links.

FIG. 4 depicts a partial element belt 401 comprising three (3) links 402. Each link 402 in the element belt 401 is configured to hold an ammunition round 321 as shown. Although only three links 402 are pictured in FIG. 4, a "full" element belt requires numerous links, as further discussed herein. Adjacent links 402 are rotatably connected to one another side-by-side, as further discussed herein.

Each link 402 comprises an upper fence guide 403 and a lower fence guide 404 on a back side 408 of the link 402. The upper fence guide 403 and lower fence guide 404 are configured to engage with and slide along rails (or wires, not shown) within the first flexible feed chute 104.

Each link 402 further comprises a top support cradle 405, a center support cradle 406, and a lower support cradle 407. The cradles 405-407 releasably retain the ammunition rounds 321 on the belt 401. In this regard, the cradles 405-407 are curved to cradle the rounds 321. Each of the cradles 405-407 comprise two curved arms that extend forwardly from the back side 408 of the link 402. The center support cradle 406 further comprises fastening means for rotatably fastening adjacent links 402 together, as further discussed with respect to FIG. 5.

Figure 5A:
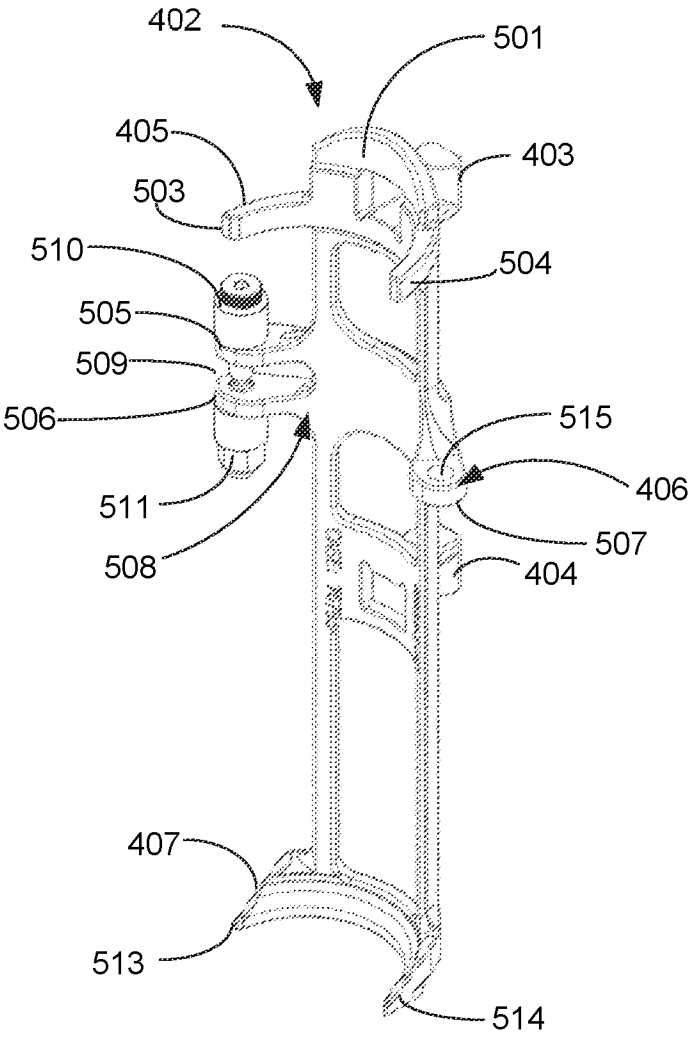
FIG. 5A is an enlarged perspective view of a single element belt link.

FIG. 5A is an enlarged perspective view of a single element belt link 402. The top support cradle 405 comprises cradle arms 503 and 504, each of which curve forwardly to support the ammunition rounds 321 (FIG. 4). The bottom support cradle 407 comprises cradle arms 513 and 514, which of which curve forwardly to support the bottom portions of the ammunition rounds 321.

The center support cradle 406 comprises opposed curved support arms 507 and 508. The curved support arm 507 comprises an opening 515 for receiving a fastener, as further discussed herein. The curved support arm 508, which is located on an opposite side of the link 402 from the curved support arm 507, is formed in two parts: an upper portion 505 and a lower portion 506.

The upper portion 505 and the lower portion 506 are spaced apart from one another vertically to form a space 509 between the upper portion 505 and the lower portion 506. The space 509 is configured to receive the center curved support arm 507 from an adjacent link (not shown) between the upper portion 505 and the lower portion 506. Each of the upper portion 505 and the lower portion 506 comprise an opening (not shown), and this opening aligns with the opening 515 of the adjacent link (not shown) for receiving a fastener 510 that rotatably affixes the adjacent links together in a side-by-side fashion.

In the illustrated embodiment, the fastener 510 comprises a vertical threaded rod (not shown) that extends through the aligned openings and is secured via a nut 511. In other embodiments, other types of fasteners may be employed to rotatably secure the adjacent links together.

Figure 5C:
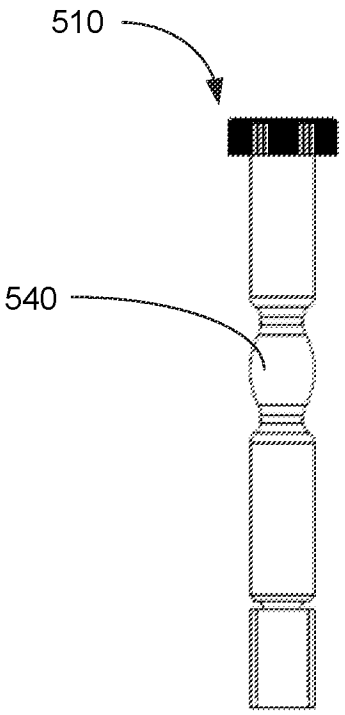
FIG. 5C is an enlarged side view of a fastener of the element belt link of FIG. 5A
Figure 5B:
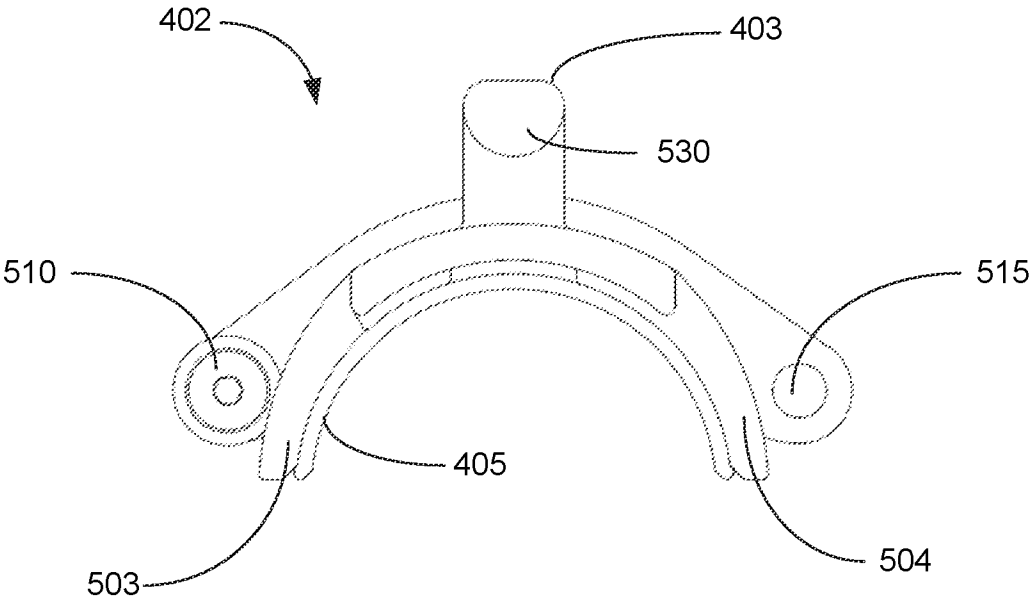
FIG. 5B is a top plan view of the single element belt link of FIG. 5A.

FIG. 5B is a top plan view of the single element belt link 402 of FIG. 5A. As discussed above, the top support cradle 405 (as well as the center support cradle and bottom support cradle (FIG. 5A)) are curved forwardly to support the individual ammunition rounds (not shown). The cradle arms 503 and 504 of the top support cradle 405 extend generally between 170 and 180 degrees around an individual ammunition round in the illustrated embodiment.

The upper fence guide 403 comprises a D-shaped ear 530 extending inwardly. A substantially similar ear (not shown) extends inwardly from the lower fence guide 404 (FIG. 5A). The ears 530 engage with the rails (or wires, not shown) within the first flexible feed chute 104 (FIG. 1).

FIG. 5C is an enlarged side view of a fastener 510 of the element belt 402 of FIG. 5A. As discussed above, the fastener 510 rotatably affixes adjacent element links together in a side-by-side fashion, while allowing the element belt to bend, twist and roll. In the illustrated embodiment, the fastener 510 comprises a bulge 540 that helps to control the bend, twist, and roll of the element belt during operation of the ammunition handling system.

Figure 6A:
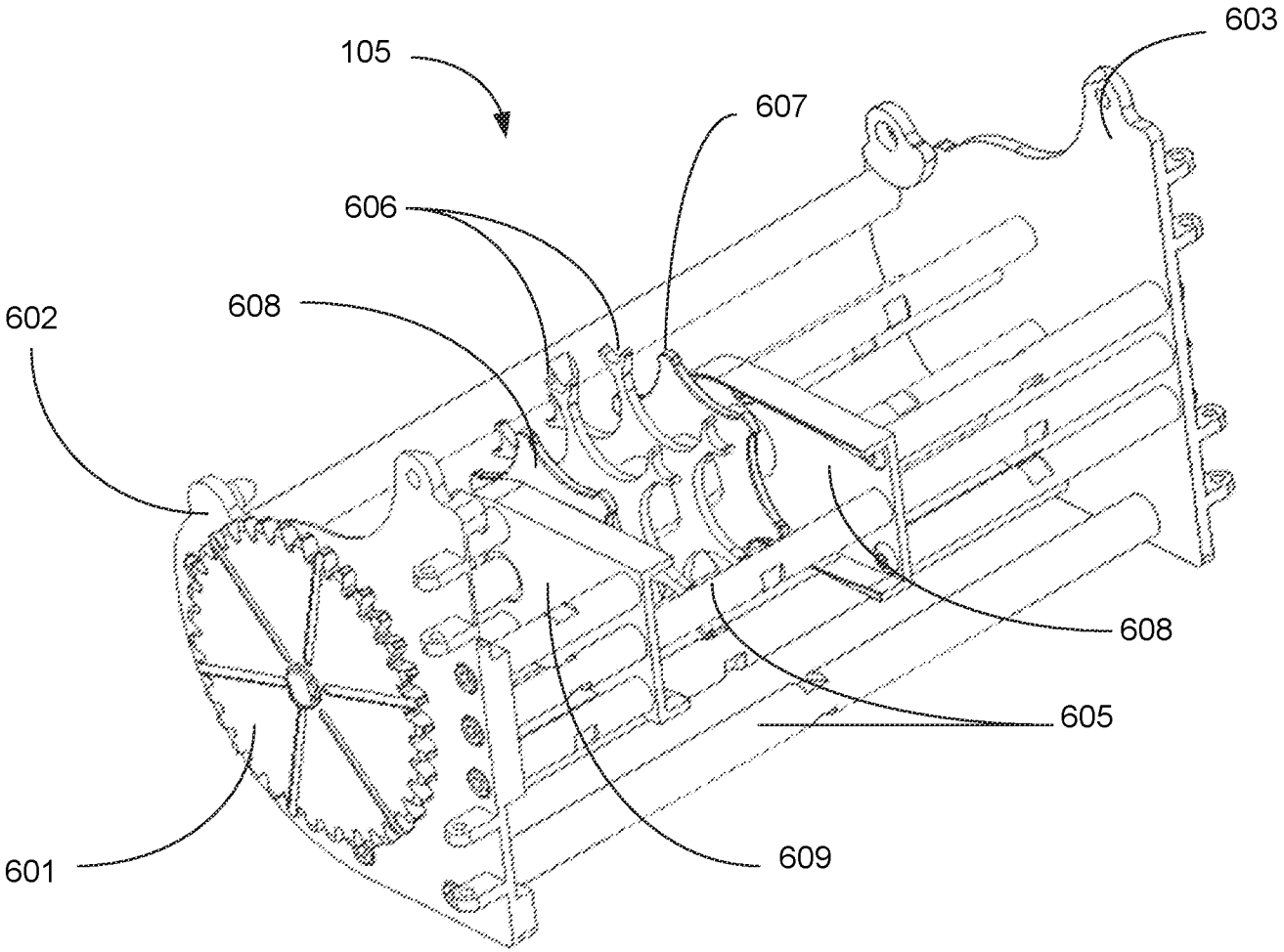
FIG. 6A depicts an exemplary gun turnaround unit according to an exemplary embodiment of the present disclosure.

FIG. 6A depicts an exemplary gun turnaround unit (GTU) 105 according to an exemplary embodiment of the present disclosure. The GTU 105 facilitates ammunition round handoff between the flex chute 104 and the GIU 106. In this regard, a plurality of element drive sprockets 606 turn the element drive belt (not shown). A GTU gear 601 turns the sprockets 606 and power the belt. Powering the element belt via the GTU 105 allows the feed chute 104 and element belt to be installed and removed without breaking the element belt, as further discussed herein.

Figure 6B:
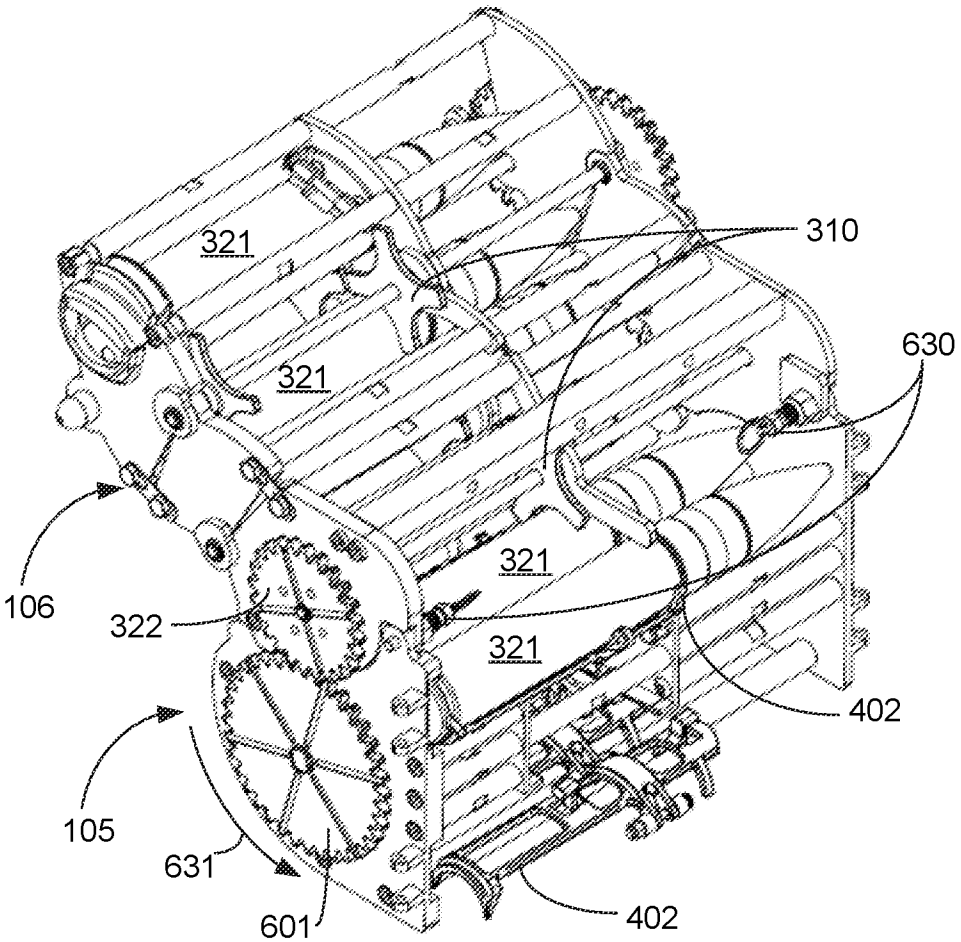
FIG. 6B depicts the GTU of FIG. 6A assembled with the GIU of FIG. 3.

FIG. 6B depicts the GTU 105 of FIG. 6A assembled with the GIU 106 of FIG. 3. As discussed above, the element belt 402 moves the ammunition rounds 321 from the flex chute 104 (FIG. 1) to the GIU 106. In this regard, a gear 601 rotates in the direction of directional arrow 631 to move the element belt 402. The individual ammunition rounds 321 are passed off from the GTU 106 to the GIU 105. The gear 322 of the GIU 105 is rotated by the gear 601. The rotation rotates the sprockets 310 within the GIU 105, and the sprockets 310 move the ammunition rounds 321 within the GIU and hand them off to the gun feeder 113 (FIG. 1) for firing.

A plurality of fasteners 610 releasably attach the GTU 105 to the GIU 106 for disconnecting the GTU 105 from the GIU 106, which may be required to replace an element belt 402.

Figure 6C:
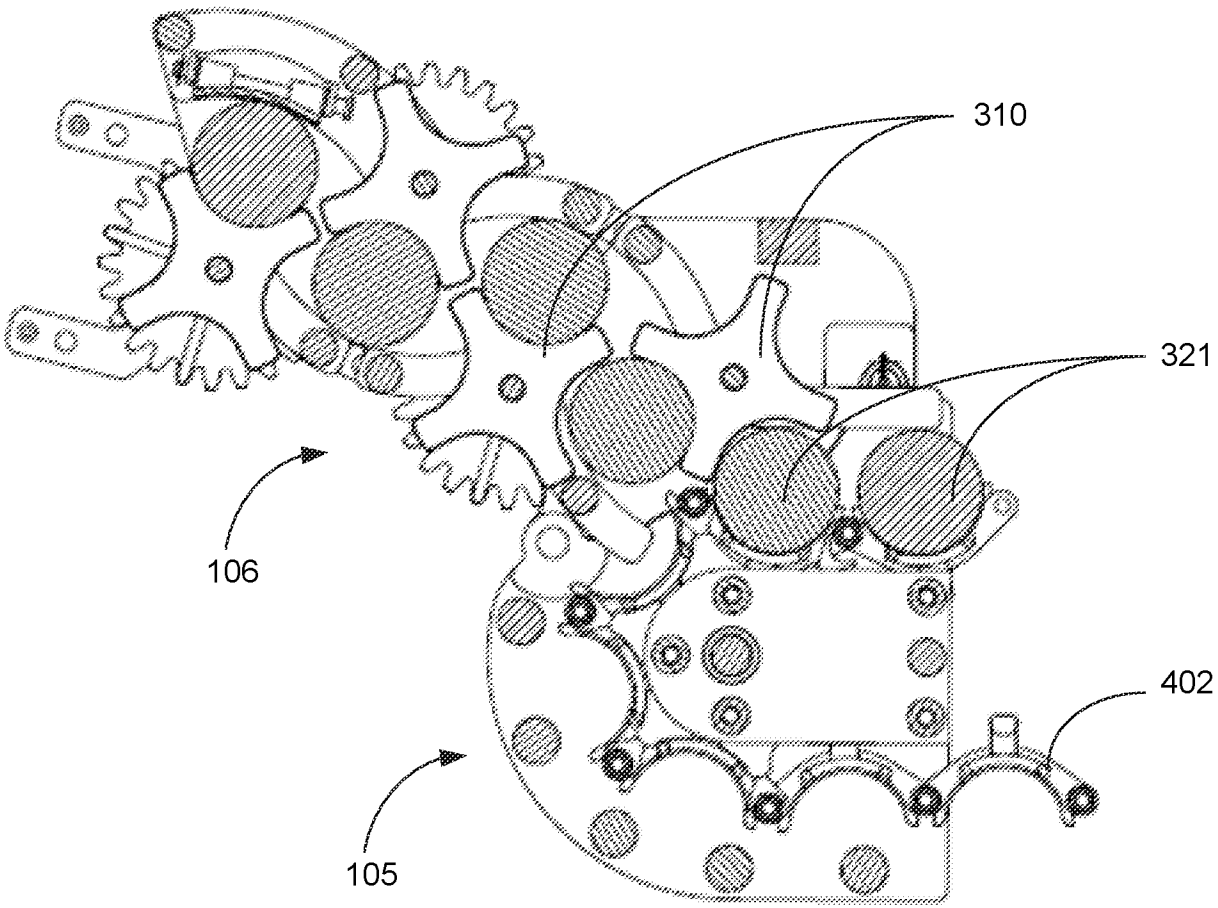
FIG. 6C is a cross-sectional representation of the GTU/GIU assembly of FIG. 6B.

FIG. 6C is a cross-sectional representation of the GTU/GIU assembly of FIG. 6B. The element belt 402 moves in a counterclockwise direction within the GTU 106, moving ammunition rounds 321 from the flex chute 104 (FIG. 1) to the GIU 106. Within the GIU 106, the ammunition rounds 321 are received by and moved via the sprockets 310 to the gun feeder 113 (FIG. 1).

Figure 7:
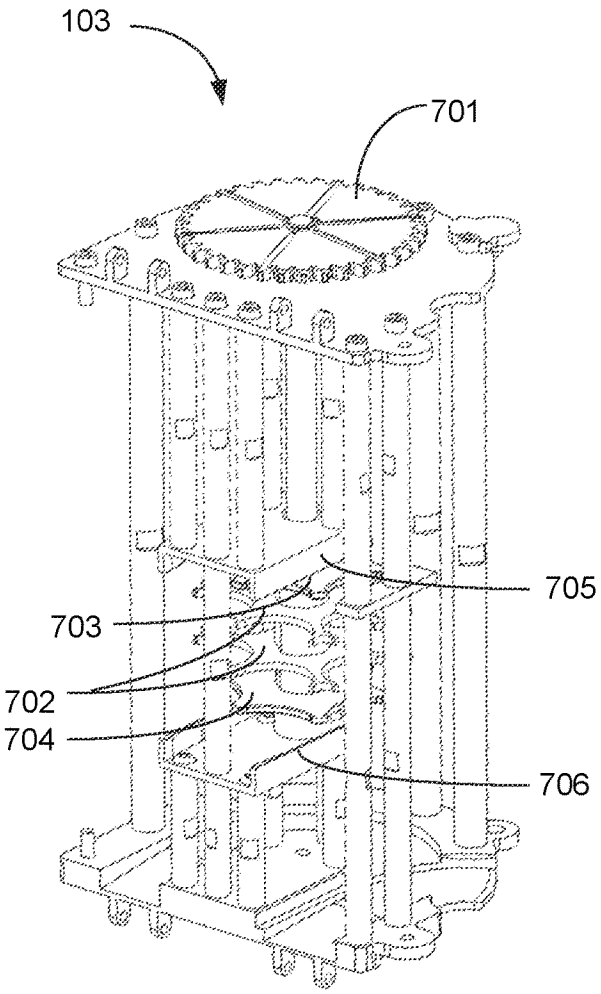
FIG. 7 depicts an exemplary magazine turnaround unit according to an exemplary embodiment of the present disclosure.

FIG. 7 depicts an exemplary magazine turnaround unit (MTU) 103 according to an exemplary embodiment of the present disclosure. The magazine turnaround unit 103 facilitates ammunition round handoff between the magazine interface unit 102 and the flex chute 104. The MTU 103 receives "power" from the element belt (not shown) and transfers it from element sprockets 701 to an MTU gear 702. The MTU 103 allows the feed chute 104 and element belt to be installed and removed without breaking the element belt, as further discussed herein.

Figure 8:
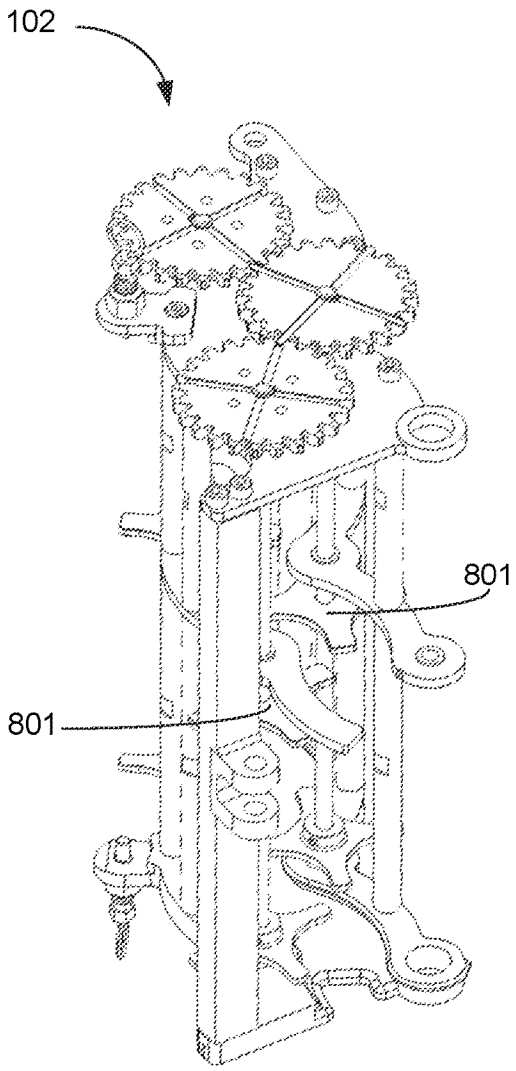
FIG. 8 depicts an exemplary magazine interface unit according to an exemplary embodiment of the present disclosure.

FIG. 8 depicts an exemplary magazine interface unit (MIU) 102 according to an exemplary embodiment of the present disclosure. The MIU 102 receives power from the MTU gear 702 (FIG. 7A) to drive MIU sprockets 801, which hand off ammunition rounds (not shown) between the magazine 101 (FIG. 1) and the MTU 103. The MIU 102 provides tension to the MTU 103 (FIG. 7A) during operation of the MTU 103.

Figure 9A:
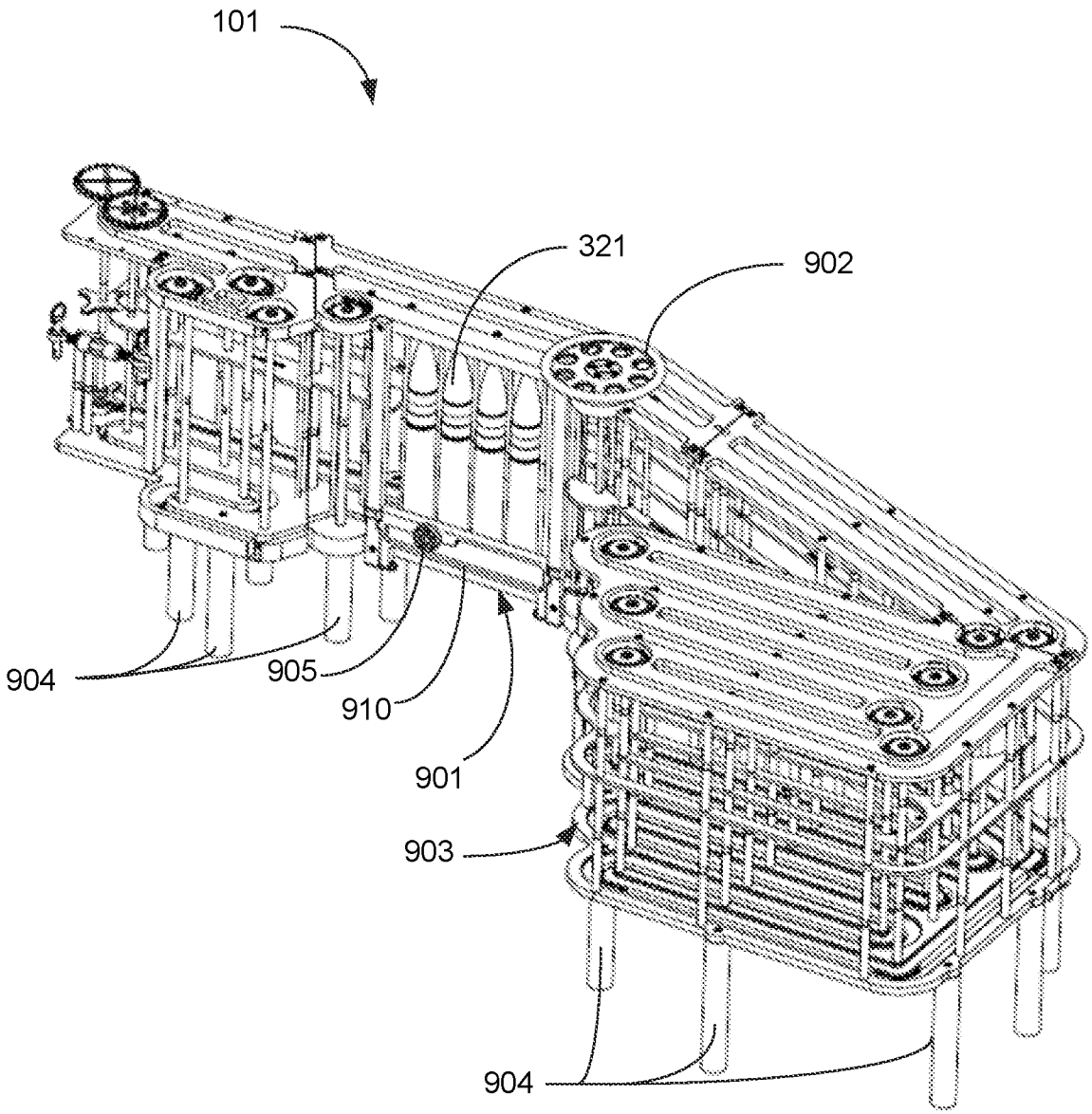
FIG. 9A depicts an exemplary magazine according to an exemplary embodiment of the present disclosure.

FIG. 9A depicts an exemplary magazine 101 according to an exemplary embodiment of the present disclosure. The magazine 101 provides high density bulk ammunition storage in a bulk storage area 903. A load zone 901 is configured to facilitate ammunition uploading and downloading. A door 910 within the load zone 901 opens to allow a user to load ammunition. In this regard, a door lock 905 is actuatable and the door 910 swings down to allow loading of the ammunition rounds 321 into the magazine, as further discussed herein. In the illustrated embodiment, a hand wheel 902 provides allows a user to drive the ammunition handling system without using a tool, for manual moving of ammunition rounds 321.

The magazine 101 comprises an internal ladder chain (FIG. 10) that is powered from the MTU 103. The magazine 101 is stationary and mounted to a turret base plate (not shown) via support posts 904 extending from a bottom side of the magazine 101.

Figure 9B:
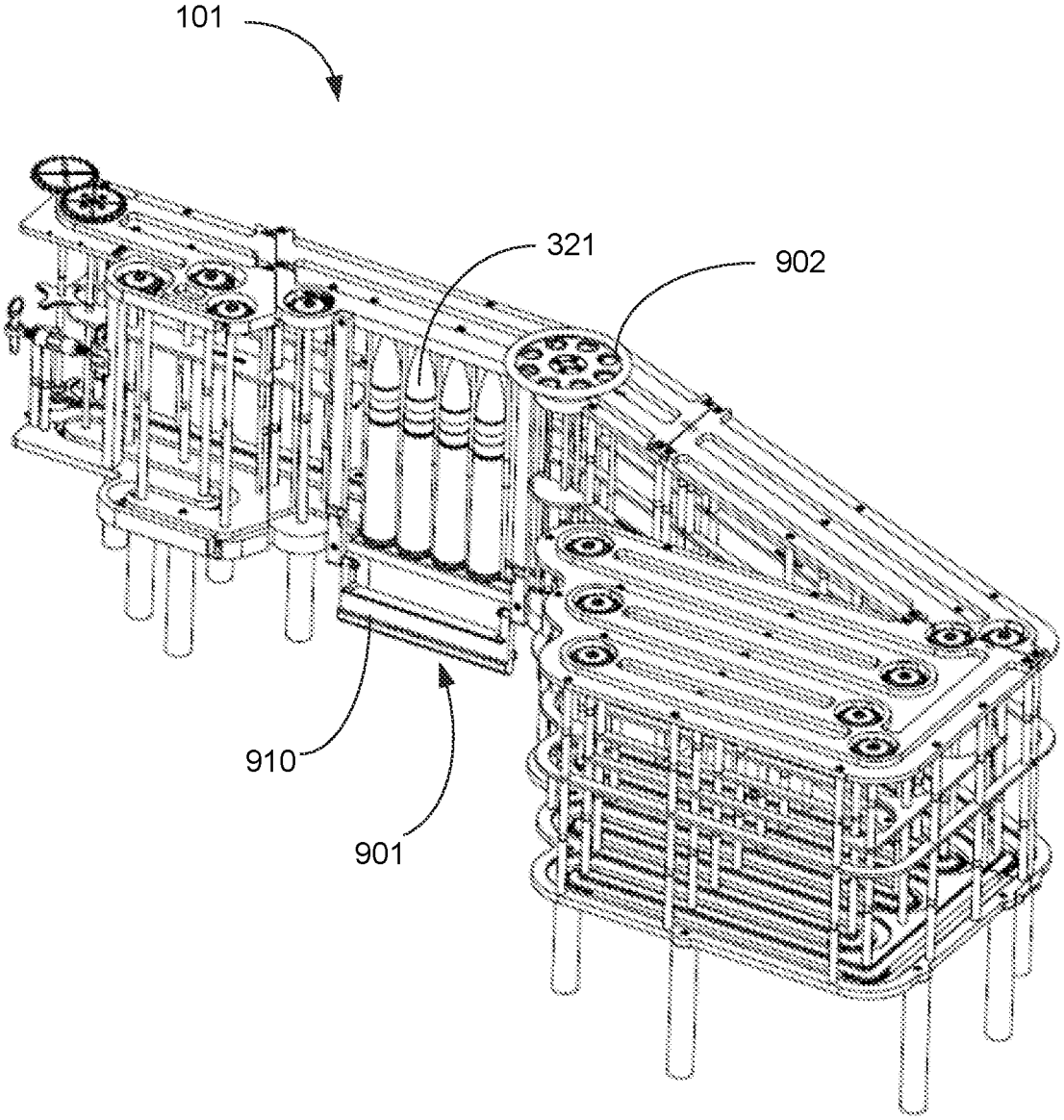
FIG. 9B depicts the exemplary magazine of FIG. 9A, with the door opened to allow loading of ammunition rounds.

FIG. 9B depicts the magazine 101 of FIG. 9A with the door 910 opened so that the ammunition rounds 321 can be loaded into the magazine 101.

Figure 10:
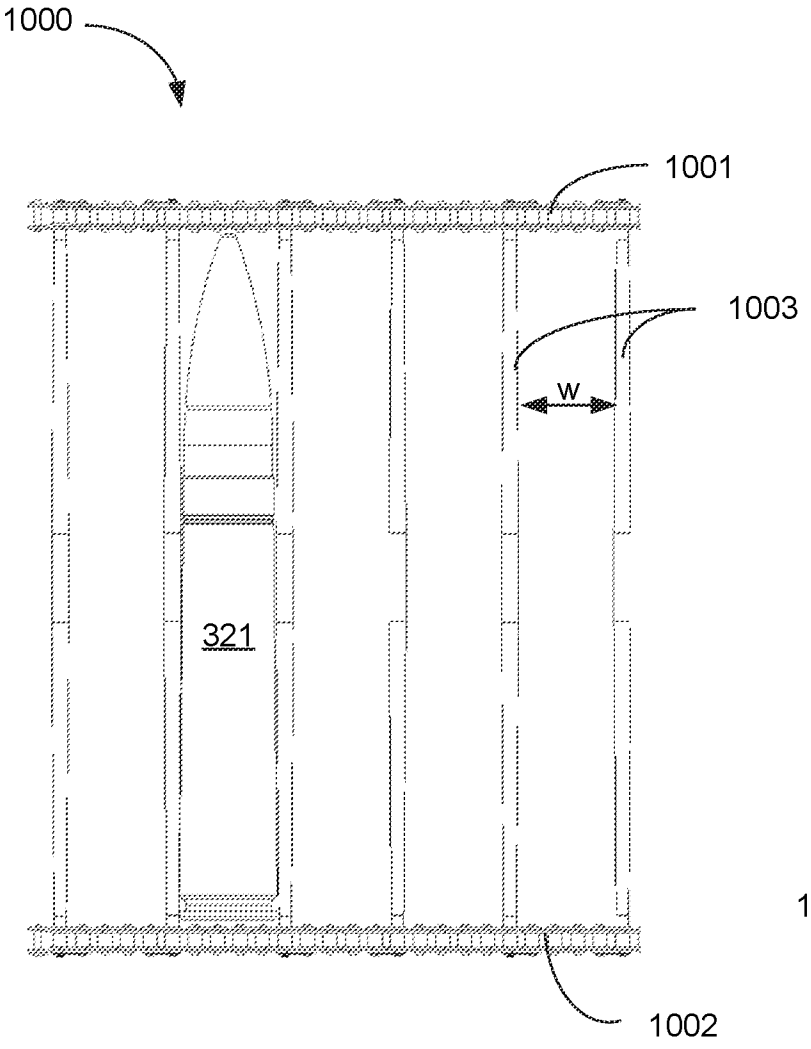
FIG. 10 depicts an exemplary ladder chain assembly according to an exemplary embodiment of the present disclosure.

FIG. 10 depicts an exemplary ladder chain assembly 1000 according to an exemplary embodiment of the present disclosure. The ladder chain assembly comprises an upper chain 1001 and a lower chain 1002, the upper chain 1001 connected to the lower chain 1002 via a plurality of ladder shafts 1003. A width "w" between adjacent ladder shafts 1003 is slightly larger than a diameter of the ammunition round 321 being loaded into the magazine 101 (FIG. 9).

Figure 11:
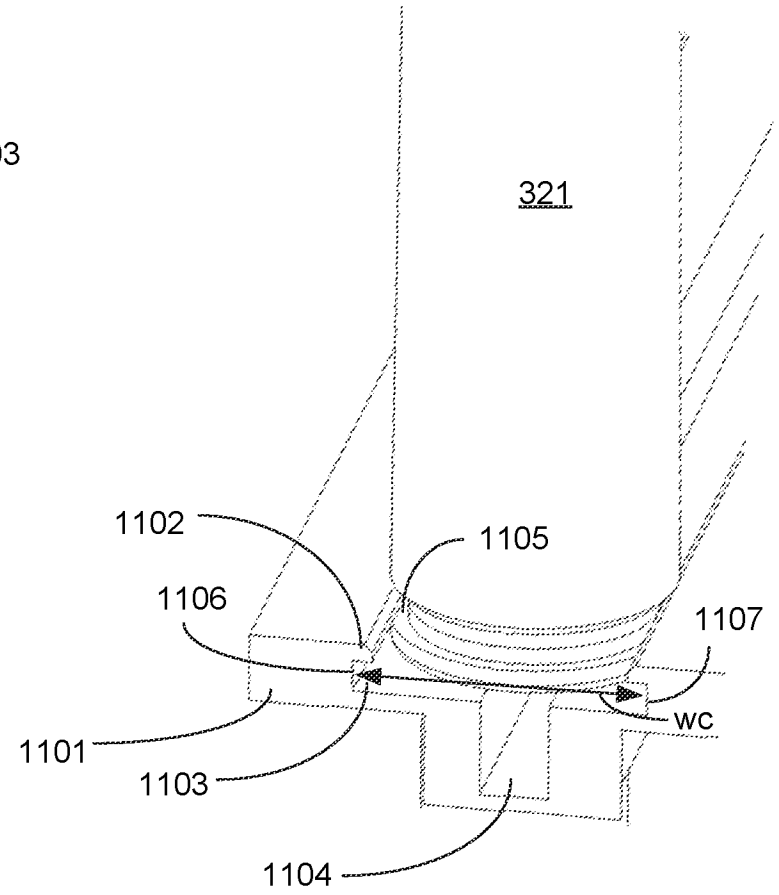
FIG. 11 is an enlarged partial view of a bottom portion of the magazine of FIG. 9, showing how ammunition rounds are controlled within the magazine.

FIG. 11 is an enlarged partial view of a bottom portion 1100 of the magazine 101 of FIG. 9, showing how ammunition rounds 321 are controlled within the magazine 101. The lower chain 1002 (FIG. 10) of the ladder chain assembly 1000 (FIG. 10) is recessed within a chain groove 1104 that runs along a bottom 1101 of the magazine 101 and a top (not shown) of the magazine 101. A case rim guide 1103 has a width "wc" slightly wider than a diameter of the round 321, and is disposed above the chain groove 1104. The round 321 contacts the case rim guide 1103 on a bottom surface 1108 of the case rim guide 1103 and is retained within opposed sidewalls 1106 and 1107 of the case rim guide 1103. Further, a protrusion 1102 of the case rim guide 1103 is received by a groove 1105 in the round 321.

In operation of the magazine, 101, the ladder chain assembly 1000 (FIG. 10) propels the rounds 321 through the magazine. The case rim guide 1103 controls the round 321 in four degrees of freedom, and the ladder chain assembly 1000 (FIG. 10) controls the other two degrees of freedom. In this manner, the magazine 101 retains complete control of the ammunition rounds 321 by contacting the casing of the ammunition rounds 321, with no contact made with the projectile itself.

What is claimed is:

1. An ammunition handling system for a medium caliber weapon, the system comprising:

a first magazine configured to store a plurality of individual ammunition rounds;

a first magazine interface unit coupled to the first magazine, the first magazine configured to convey the individual ammunition rounds to the first magazine interface unit;

a first flexible feed chute subassembly coupled to the first magazine interface unit, the first magazine interface unit configured to convey the individual ammunition rounds from the first magazine to the first flexible feed chute subassembly, the first flexible feed chute subassembly comprising a first magazine turnaround unit coupled to the first magazine interface unit, the first magazine interface unit configured to convey the individual ammunition rounds from the first magazine to the first magazine turnaround unit, a first flexible feed chute coupled to the first magazine turnaround unit, a first gun turnaround unit coupled to the first flexible feed chute, a first element belt disposed within the first flexible feed chute and extending between the first magazine turnaround unit and the first gun turnaround unit, the first element belt configured to convey the individual ammunition rounds from the first magazine turnaround unit to the first gun turnaround unit, the first element belt configured to travel in a closed loop within the first flexible feed chute, wherein the first flexible feed chute subassembly is removable from the system without breaking the first element belt;

a first gun interface unit coupled to the first flexible feed chute assembly, the first flexible feed chute subassembly configured to convey the individual ammunition rounds from the first magazine interface unit to the first gun interface unit;

a gun feeder coupled to the first gun interface unit, the first gun interface unit configured to convey the individual ammunition rounds from the first flexible feed chute subassembly to the gun feeder.

2. The system of claim 1, further comprising:

a second magazine configured to store a plurality of individual ammunition rounds;

a second magazine interface unit coupled to the second magazine, the second magazine configured to convey the individual magazine rounds to the second magazine interface unit;

a second flexible feed chute subassembly coupled to the second magazine interface unit, the second magazine interface unit configured to convey the individual ammunition rounds from the second magazine to the second flexible feed chute subassembly;

a second gun interface unit coupled to the second flexible feed chute assembly, the second flexible feed chute subassembly configured to convey the individual ammunition rounds from the second magazine interface unit to the second gun interface unit;

the second gun interface unit coupled to the gun feeder, the second gun interface unit configured to convey the individual ammunition rounds from the second flexible feed chute subassembly to the gun feeder.

3. The system of claim 2, the second flexible feed chute subassembly comprising:

a second magazine turnaround unit coupled to the second magazine interface unit, the second magazine interface unit configured to convey the individual ammunition rounds from the second magazine to the second magazine turnaround unit;

a second flexible feed chute coupled to the second magazine turnaround unit;

a second gun turnaround unit coupled to the second flexible feed chute;

a second element belt disposed within the second flexible feed chute and extending between the second magazine turnaround unit and the second gun turnaround unit, the second element belt configured to convey the individual ammunition rounds from the second magazine turnaround unit to the second gun turnaround unit, the second element belt configured to travel in a closed loop within the second flexible feed chute;

wherein the second flexible feed chute subassembly is removable from the system without breaking the element belt.

4. The system of claim 1, the first element belt comprising a plurality of links flexibly secured together, each link configured to receive and retain an individual ammunition round of the plurality of rounds by contacting a casing of the round, each link comprising a top support cradle, a center support cradle, and a lower support cradle, the top support cradle, center support cradle and lower support cradle configured to releasably retain the round via the casing.

5. The system of claim 4, wherein each of the top support cradle, center support cradle and lower support cradle comprises curved arms extending forwardly from a back side of the link.

6. The system of claim 5, wherein the center support cradle comprises a fastening means for rotatably fastening adjacent links to one another.

7. The system of claim 4, wherein each link further comprises an upper fence guide and a lower fence guide on a back side of the link, the upper fence guide and the lower fence guide configured to engage with and slide along rails within the first flexible feed chute.

8. The system of claim 1, the first gun interface unit comprising a load port configured to receive the individual ammunition rounds for conveying the individual ammunition rounds to the gun feeder without waiting for the first element belt to cycle through.

9. An ammunition handling system for a medium caliber weapon, the system comprising:

a first magazine configured to store a plurality of individual ammunition rounds, the first magazine comprising a ladder chain assembly, the ladder chain assembly comprising an upper chain and a lower chain, the upper chain connected to the lower chain via a plurality of ladder shafts, the plurality of ladders shafts substantially parallel to one another and spaced apart from one another a width slightly larger than a diameter of a casing of the individual ammunition rounds to receive the casing between adjacent ladder shafts and propel the individual ammunition rounds along the magazine, controlling two degrees of freedom of the individual ammunition rounds via contact with the casing;

a first magazine interface unit coupled to the first magazine, the first magazine configured to convey the individual ammunition rounds to the first magazine interface unit;

a first flexible feed chute subassembly coupled to the first magazine interface unit, the first magazine interface unit configured to convey the individual ammunition rounds from the first magazine to the first flexible feed chute subassembly;

a first gun interface unit coupled to the first flexible feed chute assembly, the first flexible feed chute subassembly configured to convey the individual ammunition rounds from the first magazine interface unit to the first gun interface unit;

a gun feeder coupled to the first gun interface unit, the first gun interface unit configured to convey the individual ammunition rounds from the first flexible feed chute subassembly to the gun feeder.

10. The system of claim 9, the first magazine further comprising an upper chain groove disposed along an upper portion of the magazine and a lower chain groove disposed along a lower portion of the magazine, the upper chain groove configured to receive the upper chain and the lower chain groove configured to receive the lower chain.

11. The system of claim 9, the magazine further comprising a case rim guide having a width slightly wider than a diameter of the individual ammunition rounds, the case rim guide comprising a protrusion configured to be received by a groove in the casing, the case rim guide controlling movement of the individual ammunition rounds in four degrees of freedom, such that the magazine controls the individual ammunition rounds in six degrees of freedom through contact with the casing.

12. The system of claim 9, wherein the magazine further comprises a load zone configured to allow access for loading the individual ammunition rounds into the magazine, the load zone comprising a door openable to reveal the ladder chain assembly.

13. The system of claim 9, wherein the magazine further comprises a hand wheel for actuation by a user to advance the ladder chain assembly without tools.

* * * * *